US006951504B2

(12) United States Patent
Adefris et al.

(10) Patent No.: US 6,951,504 B2
(45) Date of Patent: Oct. 4, 2005

(54) ABRASIVE ARTICLE WITH AGGLOMERATES AND METHOD OF USE

(75) Inventors: Negus B. Adefris, Woodbury, MN (US); Carl P. Erickson, Deer Park, WI (US); Brent D. Niccum, Rice Lake, WI (US); Thomas A. Sager, Forest Lake, MN (US); Craig F. Schroeder, Rice Lake, WI (US); Theodore J. Testen, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 72 days.

(21) Appl. No.: 10/393,412

(22) Filed: Mar. 20, 2003

(65) Prior Publication Data

US 2004/0185754 A1 Sep. 23, 2004

(51) Int. Cl.[7] ..... B24B 1/00

(52) U.S. Cl. ..... 451/28; 451/41; 451/166; 428/570

(58) Field of Search ..... 451/28, 41, 49, 451/56, 57, 59, 166, 168, 170, 296, 304, 305, 288, 290, 527, 530, 548, 550, 62; 428/570

(56) References Cited

U.S. PATENT DOCUMENTS

| | | | | |
|---|---|---|---|---|
| 4,653,996 A | | 3/1987 | Ozaki et al. | |
| 4,725,508 A | * | 2/1988 | Rangaswamy et al. | 428/570 |
| 4,799,939 A | | 1/1989 | Bloecher et al. | |
| 4,833,834 A | | 5/1989 | Patterson et al. | |
| 5,098,748 A | | 3/1992 | Shimizu et al. | |
| 5,216,845 A | * | 6/1993 | Buljan et al. | 451/28 |
| 5,456,734 A | | 10/1995 | Ryoke et al. | |
| 5,500,273 A | | 3/1996 | Holmes et al. | |
| 5,578,096 A | | 11/1996 | Christianson et al. | |
| 5,611,826 A | | 3/1997 | Ryoke et al. | |
| 5,633,068 A | | 5/1997 | Ryoke et al. | |
| 5,667,541 A | | 9/1997 | Klun et al. | |
| 5,743,788 A | * | 4/1998 | Vanell | 451/41 |
| 5,840,090 A | * | 11/1998 | Ho et al. | 51/295 |
| 5,958,794 A | * | 9/1999 | Bruxvoort et al. | 438/692 |
| 6,004,189 A | * | 12/1999 | Phillips | 451/49 |
| 6,217,413 B1 | | 4/2001 | Christianson | |
| 6,234,875 B1 | * | 5/2001 | Pendergrass, Jr. | 451/41 |
| 6,354,929 B1 | | 3/2002 | Adefris et al. | |
| 2002/0028264 A1 | | 3/2002 | Hoopman et al. | |
| 2002/0090891 A1 | | 7/2002 | Adefris et al. | |

FOREIGN PATENT DOCUMENTS

| | | |
|---|---|---|
| EP | 0 265 800 | 5/1988 |
| GB | 867455 | 5/1961 |
| WO | WO 99/42250 | 8/1999 |
| WO | WO 00/64630 | 11/2000 |
| WO | WO 00/64633 | 11/2000 |
| WO | WO 01/83166 A1 | 11/2001 |

* cited by examiner

*Primary Examiner*—Lee D. Wilson
*Assistant Examiner*—Anthony Ojini
(74) *Attorney, Agent, or Firm*—Colene H. Blank

(57) ABSTRACT

The present inventions is directed to a method of polishing a workpiece. The method comprises providing an abrasive article, the abrasive article comprising superabrasive particles within agglomerates. The method then comprises contacting the abrasive article with a workpiece outer surface, the workpiece outer surface comprising a thermal spray hard phase, and relatively moving the abrasive article and the workpiece. The workpiece outer surface may further comprises a bonding phase. The abrasive article may be a continuous belt, an abrasive tape or a resin bonded disk.

23 Claims, 1 Drawing Sheet

ABRASIVE ARTICLE WITH AGGLOMERATES AND METHOD OF USE

FIELD

The present invention is directed to abrasive articles and method of using such abrasive articles.

BACKGROUND

The roll grinding industry requires a polishing step to impart a desired finish on metallic parts. Currently, this polishing step is performed with either grinding wheels or flexible diamond belts. Conventional diamond belts typically consist of a single layer of abrasive grain adhered to a backing. Examples of flexible diamond belts include those sold under the tradenames 6450J Flex Diamond 50, 6450J Flex Diamond 74, and 1451J Flex CBN 40, all available from 3M Company, St. Paul, Minn. However, in order to obtain a more efficient use of the abrasives in a coated abrasive, some coated abrasives have been made with abrasive agglomerates.

However, grinding wheels suitable for a polishing finish have low material removal rates during use, resulting in a slow manufacturing process and have the potential of failing catastrophically, by disintegration or shatter. Conventional flex diamond belts have limited life and are expensive.

SUMMARY

The present inventions is directed to a method of polishing a workpiece. The method comprises providing an abrasive article, the abrasive article comprising superabrasive particles within agglomerates. The method then comprises contacting the abrasive article with a workpiece outer surface, the workpiece outer surface comprising a thermal spray hard phase, and relatively moving the abrasive article and the workpiece. The workpiece outer surface may further comprises a bonding phase. The abrasive article may be a continuous belt, an abrasive tape or a resin bonded disk.

DETAILED DESCRIPTION

Abrasive Article

Figure 1:
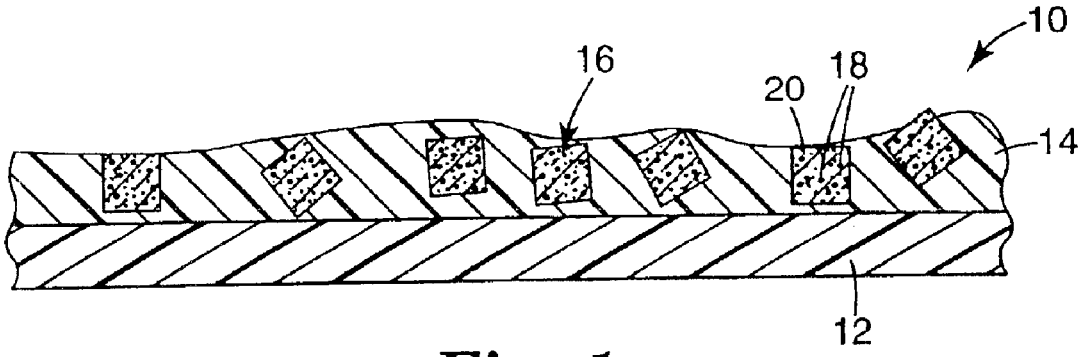
FIG. 1 is a cross sectional view of an abrasive article of the present invention.

FIG. 1 illustrates an embodiment of an abrasive article 10 for use in the present invention. The abrasive article 10 comprises a backing 12 and an abrasive coating. The abrasive coating comprises a binder 14 and abrasive agglomerates 16 dispersed within the binder 14. The abrasive agglomerates 16 comprise abrasive particles 18 held within an agglomerate binder 20. Examples of abrasive articles suitable for the present invention are also described in U.S. Pat. No. 6,217,413 to Christianson, incorporated herein by reference in its entirety.

Backing

The backing 12 for the abrasive article 10 may be any material suitable for use in the intended application. Specifically, the backing may be any material suitable as an abrasive article backing and is compatible with the components of the agglomerates and maintains its integrity under curing and abrading conditions. Generally, the backing is a conformable, flexible sheet. Examples of backings are well-known in the art and include vulcanized fibers, polymers, papers, woven and non-woven fabrics, and foils. Specific examples of backings include polyesters and woven polyester fabrics.

Binder

The binder 14 is coated onto the backing 12. Typically, binder is a single layer as shown in the embodiment in FIG. 1. However, the binder could also be a layer on the backing (the make coat) and a second layer over the agglomerates (the size coat.)

Generally, the binder is formed from organic-based binder precursors, for example, resins. Upon exposure to the proper conditions, such as an appropriate energy source, the resin polymerizes to form a cross-linked thermoset polymer or binder. Examples of typical resinous adhesives include phenolic resins, aminoplast resins having pendant alpha, beta, unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorine modified epoxy resins, and mixtures thereof. Generally, epoxy resins and phenolic resins are used.

Phenolic resins are widely used as binder precursors because of their thermal properties, availability, cost, and ease of handling. There are two types of phenolic resins, resole and novolac. Resole phenolic resins typically have a molar ratio of formaldehyde to phenol, of greater than or equal to one to one, typically between 1.5:1 to 3:1. Novolac resins typically have a molar ratio of formaldehyde to phenol, of less than to one to one.

Epoxy resins have an oxirane ring and are polymerized by the ring opening. Suitable epoxy resins include monomeric epoxy resins and polymeric epoxy resins and can have varying backbones and substituent groups. In general, the backbone may be of any type normally associated with epoxy resins, for example, Bis-phenol A, and the substituent groups can include any group free of an active hydrogen atom that is reactive with an oxirane ring at room temperature. Representative examples of suitable substituent groups include halogens, ester groups, ether groups, sulfonate groups, siloxane groups, nitro groups and phosphate groups.

Examples of epoxy resins include 2,2-bis[4-(2,3-epoxypropoxy)-phenyl]propane (a diglycidyl ether of bisphenol. Other suitable epoxy resins include glycidyl ethers of phenol formaldehyde novolac.

Ethylenically unsaturated resins include both monomeric and polymeric compounds that contain atoms of carbon, hydrogen, and oxygen, and optionally, nitrogen and halogen atoms. Oxygen or nitrogen atoms or both are generally present in ether, ester, urethane, amide, and urea groups. Ethylenically unsaturated compounds generally have a molecular weight of less than about 4,000, and may be esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, and maleic acid.

Representative examples of acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, pentaerythritol tetraacrylate and pentaerythritol tetraacrylate.

Other ethylenically unsaturated resins include monoallyl, polyallyl, and polymethallyl esters and amides of carboxylic acids, such as diallyl phthalate, diallyl adipate, and N,N-diallyladkipamide. Other suitable nitrogen-containing compounds include tris(2-acryloyl-oxyethyl)isocyanurate, 1,3,5-tri(2-methyacryloxyethyl)-s-triazine, acrylamide, methylacrylamide, N-methylacrylamide, N,N-dimethylacrylamide, N-vinylpyrrolidone, and N-vinylpiperidone.

The binder may further comprise optional additives, such as, for example, fillers (including grinding aids), fibers, antistatic agents, lubricants, wetting agents, surfactants, pigments, dyes, coupling agents, plasticizers, and suspending agents. The amounts of these materials can be selected to provide the properties desired.

Examples of useful fillers for this invention include metal carbonates (such as calcium carbonate (e.g., chalk, calcite, marl, travertine, marble, and limestone), calcium magnesium carbonate, sodium carbonate, and magnesium carbonate); silica (such as quartz, glass beads, glass bubbles, and glass fibers); silicates (such as talc, clays (e.g., montmorillonite) feldspar, mica, calcium silicate, calcium metasilicate, sodium aluminosilicate, sodium silicate); metal sulfates (such as calcium sulfate, barium sulfate, sodium sulfate, aluminum sodium sulfate, aluminum sulfate); gypsum; vermiculite; wood flour; aluminum trihydrate; carbon black; metal oxides (such as calcium oxide (lime), aluminum oxide (alumina), and titanium dioxide); and metal sulfites (such as calcium sulfite). The filler typically has an average particle size ranging from about 0.1 to 100 micrometers, preferably between 1 to 50 micrometers, more preferably between 1 and 25 micrometers.

Suitable grinding aids include particulate material, the addition of which has a significant effect on the chemical and physical processes of abrading which results in improved performance. In particular, a grinding aid may 1) decrease the friction between the abrasive grains and the workpiece being abraded, 2) prevent the abrasive grain from "icapping", i.e., prevent metal particles from becoming welded to the tops of the abrasive grains, 3) decrease the interface temperature between the abrasive grains the workpiece and/or 4) decrease the grinding forces. In general, the addition of a grinding aid increases the useful life of the coated abrasive. Grinding aids encompass a wide variety of different materials and can be inorganic- or organic-based.

Examples of grinding aids include waxes, organic halide compounds, halide salts and metals and their alloys. The organic halide compounds will typically break down during abrading and release a halogen acid or a gaseous halide compound. Examples of such materials include chlorinated waxes like tetrachloronaphthalene, pentachloronaphthalene; and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metals include tin, lead, bismuth, cobalt, antimony, cadmium, iron, and titanium. Examples of other grinding aids include sulfur, organic sulfur compounds, graphite, and metallic sulfides. A combination of different grinding aids can also be used. The above mentioned examples of grinding aids are meant to be a representative showing of grinding aids and are not meant to encompass all grinding aids.

Examples of antistatic agents include graphite, carbon black, vanadium oxide, humectants, and the like. These antistatic agents are disclosed in U.S. Pat. Nos. 5,061,294; 5,137,542; and 5,203,884.

Generally, the slurry used to make the binder comprises from about 5 to 95 weight % of a binder precursor, and between about 5 to 95 weight %, of the abrasive particles and any additive.

Abrasive Agglomerates

The agglomerates can be irregularly shaped or have a precise shape associated with them, for example, a cube, pyramid, truncated pyramid, or a sphere. An agglomerate comprises abrasive particles or grains within a permanent binder matrix. The permanent binder matrix can be organic or inorganic. Examples of organic binders include phenolic resins, urea-formaldehyde resins, and epoxy resins. Example of inorganic binders include metals (such as nickel), and metal oxides. Metal oxides are usually classified as either a glass (vitrified), ceramic (crystalline), or glass-ceramic. Specific examples of the permanent binder include glass powder and colloidal metal oxides, for example, silica.

The agglomerates of the present invention can be prepared by the following procedure. Abrasive particles are mixed with a temporary binder and a permanent binder in solution to form a slurry. Generally, the mixture is agitated to disperse the abrasive particles. Specific examples of temporary binders include dextrin in water.

After the mixing step is complete, the slurry is moved into a mold, for example, a tooling bearing multiple cavities. The cavities in the tooling can have many different shapes, for example, a truncated pyramid. Excess slurry is removed, resulting in discrete molds filled with the slurry. The slurry is then solidified by drying, for example, at room temperature for about 15 to about 20 hours. Solidification results from removal of the liquid from the mixture. The dried particles are agglomerate precursors, held together by the temporary binder. The temporary binder materials bind the agglomerates before final firing, but would generally be removed when the permanent binder is activated, for example the temporary binder would burn away in a firing step.

The agglomerate precursors are then removed from the tooling, and the permanent binder is activated. This is generally accomplished by heat to fuse the permanent binder, or by radiation to activate a solidification process. For example, the agglomerate precursors, with a glass permanent binder, are fused by heating an oven at about 400° C. for about 2 hours and then the temperature is raised to within about 30° C. of the softening point of the glass for about 1 hour.

The average agglomerate size is generally at least about 20 micrometers, in some embodiments at least about 38 micrometer. In some embodiments, the abrasive particles may be as large as 600 micrometers, and even as large as 1000 micrometers.

The agglomerates of this invention are then used to make coated abrasive products, bonded abrasive products, e.g., grinding wheels, nonwoven abrasive products, and other products where abrasive grains are typically employed.

Abrasive Particles

The abrasive particles suitable for this invention include abrasive particles known as superabrasive particles. Superabrasive particles generally have a Mohs hardness of greater than 8. Examples of such superabrasive particles include diamond and cubic boron nitride. The abrasive particles can be either shaped (e.g., rod, triangle, or pyramid) or unshaped (i.e., irregular).

The average particle size of the abrasive particle for advantageous applications of the present invention is at least about 0.1 micrometers, in some embodiments at least about 0.5 micrometer and in other embodiments, at least about 1.5 micrometers. In some embodiments, the abrasive particles may be as large as 300 micrometers. The abrasive particles are then placed in the abrasive agglomerates of the present invention.

Method of Making the Abrasive Article

Coated abrasive products may be manufactured using the agglomerates as described above. The abrasive coating comprising agglomerates and binder may be applied to a backing to form the coated abrasive. The abrasive coating can be applied by any known means, i.e., drop coating, slurry coating, electrostatic coating, roll coating, etc. Methods of manufacturing abrasive articles suitable for the present invention are also described in U.S. Pat. No. 6,217,413 to Christianson, incorporated herein by reference in its entirety.

The coated abrasive can be prepared in the conventional manner, e.g. applying a make coat over the backing, drop coating the agglomerates over the make coat, applying a size coat, and then curing the thus-applied coatings. Care should be taken so that the size coat does not adversely affect erodability of the agglomerates, i.e., the size coat should not flood the surface of the coated abrasive. Alternatively, in many cases, a size coat is not required, particularly when the resinous binder of the agglomerate is a material normally employed for preparing size coats.

The abrasive article may also be manufactured using a slurry coating process. In such a process, the agglomerate, the binder precursor, and any optional additives are agitated to form a slurry. The slurry is then coated onto the backing. The slurry may be coated thinly to allow for a single layer of agglomerate, or a thicker coat which creates multiple agglomerates dispersed throughout the thickness of the coating. The binder is then solidified, for example by initiating a polymerization reaction.

The abrasive article of the invention can be used by hand or used in combination with a machine such as a belt grinder. The abrasive article can be converted, for example, into a belt, tape rolls, disc, or sheet.

For belt applications, the two free ends of an abrasive sheet are joined together and spliced, thus forming an endless belt. A spliceless belt can also be used. Generally, an endless abrasive belt can traverse over at least one idler roll and a platen or contact wheel. The hardness of the platen or contact wheel is adjusted to obtain the desired rate of cut and workpiece surface finish. The abrasive belt speed depends upon the desired cut rate and surface finish and generally ranges anywhere from about 20 to 100 surface meters per second, typically between 30 to 70 surface meter per second. The belt dimensions can range from about 0.5 cm to 100 cm wide, preferably 1.0 to 30 cm, and from about 5 cm to 1,000 cm long, preferably 50 to 500 cm.

Abrasive tapes are continuous lengths of the abrasive article and can range in width from about 1 mm to 1,000 mm, preferably between 5 mm to 250 mm. The abrasive tapes are usually unwound, traversed over a support pad that forces the tape against the workpiece, and then rewound. The abrasive tapes can be continuously fed through the abrading interface and can be indexed.

Abrasive discs, which may also include that which is in the shape known in the abrasive art as "daisy", can range from about 50 mm to 1,000 mm in diameter, preferably 50 to 100 mm. Typically, abrasive discs are secured to a back-up pad by an attachment means and can rotate between 100 to 20,000 revolutions per minute, typically between 1,000 to 15,000 revolutions per minute.

Workpiece

Several workpieces, for example crankshafts, benefit from being light and hard. Workpieces may be formed of a light alloy, for example an aluminum alloy, or steel. However, these workpieces may have inferior mechanical properties, such as wear resistance.

Therefore, the workpiece may be coated with a coating. Such coatings commonly are applied as abrasion resistance coatings on components, roll coatings, thermal barrier coatings, heat resistant coatings, dimensional restoration coatings and other hard to grind coatings that may be applied to surfaces for the purpose of improving surface mechanical properties. One type of hard coating is referred to as thermal spray coating. Impacting molten or nearly molten particles at high velocity onto a substrate produces such coatings In specific embodiments, the coating is a thermal spray coating. The coating creates an outer surface comprising the coating. The coating is generally a hard phase material, for example a metal alloy, a ceramic or a combination of metallic and ceramic in order to improve durability. In some embodiments, the coating will comprise both a hard phase and a bonding phase.

Examples of hard phase coatings include, for example, metal oxides, such as aluminum oxide and zirconium oxide, carbides, such as titanium carbide and chromium carbide, nitrides such as titanium nitride and silicon nitride, and hard metal coatings such as chrome-nickel-boron alloys. In specific examples, the coating is tungsten carbide.

In certain embodiments, the coating comprises a hard phase and a bonding phase. The bonding phase binds the hard phase to the workpiece. Generally, the bonding phase will have a melting temperature lower than the melting temperature of the hard phase, to facilitate it acting as a binding agent. Examples of bonding phase materials include metals and metal oxides. Specific examples include cobalt. One specific coating is tungsten carbide and cobalt. Generally, the hard phase is between 85% and 99% by weight of the coating and between about 1% and about 15% by weight of the bonding phase.

The thermal spray coating is generally coated to the workpiece by any suitable method, including flame spraying, plasma arc spraying, transferred plasma arc spraying, electric arc spraying and flame spray and fuse. These methods are known to one of skill in the art.

Method of Using the Abrasive Article

The workpiece may be coated to enhance strength, as discussed above. In such a case, the surface to be polished comprises the outer surface of the workpiece. The method entails providing an abrasive article comprising superabrasive particles within agglomerates, and contacting the abrasive article with a workpiece. The workpiece generally has an outer surface comprising a thermal spray hard phase. In some embodiments, the outer surface further comprises a bonding phase.

The abrasive article is put into contact with the outer surface of the workpiece. The abrasive article is then moved relative to the workpiece. A coolant may be introduced to the interface. Generally, a belt will be run at the optimum speed for the abrasive particle within the agglomerate, generally as fast as a system allows.

EXAMPLES

This invention is further illustrated by the following examples that are not intended to limit the scope of the invention. These examples are merely for illustrative purposes only and are not meant to be limiting on the scope of the appended claims.

Preparation of Agglomerates

Agglomerates 1–2

The formulation for the temporary binder solution is reported in Table 1. This binder offered adequate green strength of the agglomerates before firing and burns off clearly during the firing process. The formulation was mixed in a closed beaker in an ultrasonic bath until dissolved.

TABLE 1

| Temporary Binder for Mineral | |
|---|---|
| Dextrin | 25.0 g |
| De-ionized Water | 75.0 g |
| Total | 100.0 g |

The glass powders used were alumino-borosilicate type obtained from Specialty Glass Incorporated of Marlborough, Fla. under the designations SP1086 or SP2014. Other ingredients included sodium diamyl sulfosuccinate, a surfactant, obtained from Cytec Corporation of West Paterson, N.J. under the designation Aerosol AY100, and Dow-Corning 65 defoamer obtained from Dow Corning Corporation of Midland, Mich. The formulations of Table 2 were used to make 50 microns diamond agglomerated high strength and low strength particles respectively. The diamond particles were obtained from National Research Company in Chesterfield, Mich. under a trade name of SMB-5.

TABLE 2

| Slurry Formulation for Mineral in weight percent | | |
|---|---|---|
| | Agglomerate 1 | Agglomerate 2 |
| Median Crush Strength | 5476 psi | 2987 psi |
| Glass powder (SP1086) | — | 38.07 |
| Glass powder (SP2014) | 38.07 | — |
| Diamond (50 micron) | 38.07 | 38.07 |
| 25% Dextrin in Water | 22.84 | 22.84 |
| AY 50 (50% MEK) | 0.76 | 0.76 |
| Dow 65 | 0.25 | 0.25 |
| Total | 100 | 100 |

In each case, the slurry was thoroughly mixed by stirring in an open beaker system for five minutes followed by an ultrasonic bath for a period of 30 minutes. Polypropylene tooling having cavities in the form of a truncated square pyramid shape having dimensions of 0.36 mm×0.36 mm×0.36 mm and a taper angle of 10 degrees was then coated to fill the cavities with the slurries prepared above. Excess material was removed. After filling the tooling cavities, the slurry was dried at room temperature overnight. Following drying, the agglomerate precursors were removed from the tooling with the aid of an ultrasonic horn. The resulting green bodies were then transferred to a refractory sager and heated to 400° C. at a heating rate of 1.5° C. per minute and held for 2 hours at that temperature.

The temperature was then raised to within 30° C. of the softening point of the glass at a heating rate of 2° C. per minute and held for 1 hour at that temperature to fuse the agglomerates. This temperature is selected to give the desired property for a given glass. Lower temperatures tend to give lower bond strength and higher temperatures tend to give higher bond strength. After fusing, the temperature of the furnace was cooled to room temperature at a cooling rate of 2° C. per minute.

The strength of the agglomerates was evaluated using compression testing of the agglomerates and quantifying the strength distribution. The median load that the agglomerates could withstand with 50% survival probability was quantified for all batches of agglomerates that were produced. The force required to crush a particle was measured with a Shimpo Force Gage designated FGE-50 obtained from Shimpo Instruments in Itasca, Ill.

The two glass frits obtained from Specialty Glass Inc. of Marlborough, Fla., SP1086 and SP2014, when fired at 685° C. and 820° C. offered median strengths of 2987 psi and 5476 psi respectively.

Agglomerate 3

The method described for Agglomerates 1 and 2 was used to produce agglomerates incorporating 74 micron diamond using the formulation in the following Table 3. These agglomerates were formed by molding them in cavities with 0.36 mm×0.36 mm×0.36 mm pocket dimensions. These agglomerates were fired at 710° C. for a period of one hour in a refractory sager. The rest of the heating and the cooling cycle conditions were the same as above for Agglomerates 1 and 2.

TABLE 3

| Material | Weight [grams] |
|---|---|
| Glass powder (SP1086) | 38.07 |
| Diamond 74 micron | 38.07 |
| 25% Dextrin in Water | 22.84 |

TABLE 3-continued

| Material | Weight [grams] |
|---|---|
| AY 50 (50% MEK) | 0.76 |
| Dow 65 | 0.25 |
| Total | 100 |

Agglomerates 4–5

Cubic Boron Nitride (CBN) particles, obtained from Pinnacle Abrasives of Walnut Creek, Calif. under the trade name of HS-2, were formed into agglomerates using the following formulation in the procedure used to form Agglomerates 1 and 2. The glass powder used was SP2014. The process of making CBN and diamond agglomerate was identical. The following Table 4 shows the components used to prepare the slurry for the CBN particles.

TABLE 4

| | Agglomerate 4 | Agglomerate 5 |
|---|---|---|
| Size | 40 micron | 74 micron |
| Glass powder (SP2014) | 36.68 | 38.07 |
| CBN | 36.68 | 38.07 |
| 25% Dextrin in Water | 25.67 | 22.84 |
| AY 50 (50% MEK) | 0.73 | 0.76 |
| Dow 65 | 0.24 | 0.25 |
| Total | 100 | 100 |

Backing

Polyester fabric backing material identified as twin ply woven polyester cloth Type X642 obtained from Sampla Belting SPA of Milan, Italy was used as the backing for the coated abrasives. This cloth was treated with a primer epoxy resin before abrasive is coated on the front side to enhance the adhesion of the abrasives to the woven backing. The formulation used as a pre-coat treatment is reported in Table 5. This resin was applied at 0.025 mm (0.001 inch) gap using a notched bar coater and cured overnight at room temperature.

TABLE 5

| Backing Precoat Formulation. | | | | |
|---|---|---|---|---|
| Component | Source | Weight | Solids | Percent By Weight |
| Epon 828 resin | Resolution Performance Products, Houston, TX | 408.6 | 100% | 30 |
| Versamid 125 | Henkel Corporation Ambler, PA | 272.4 | 100% | 20 |
| Polysolve | Dupont Corporation, Wilmington, DE | 681 | — | 50 |
| Total | | 1362 | | 100 |

The front side was then coated with a mixture of binder precursor and agglomerated particles. The precursor was prepared in accordance with the formulation reported in Table 6. The resinous base for the precursor was aqueous polymer solution phenol resin. The aqueous phenolic resin used was internally produced resole phenolic resin containing between 0.75 to 1.4% free formaldehyde and 6 to 8% free phenol, percent solids about 78% with the remainder being water, pH about 8.5, with less than 1% Sodium Hydroxide Catalyst and viscosity between about 2400 and 2800 centipoise. An equivalent resole phenolic resin is commercially available from Ashland Chemical Company, in Covington, Ky. under the trade name Arofene. This resin was combined with fumed silica obtained from Cabot Corporation in Tuscola, Ill. under the trade name Cabosil; 9 micron aluminum oxide powder, obtained from Treibacher Schleifmittel AG of Villach, Austria; peerless clay obtained from R. T. Vanderbilt Company of Norwalk, Conn. under the designation ASP 600 peerless clay; and Interwet 33 obtained from Akcros Chemicals in New Brunswick, N.J. in the proportions indicated in Table 6. The mixture was agitated thoroughly for a period of about 30–45 minutes before use.

TABLE 6

Agglomerate Binder Precursor Formulation

| Raw Material | Company | Weight Percent | Percent Solids |
|---|---|---|---|
| Phenolic Resin | 3M | 66.96 | 76% |
| Water | — | 16.99 | 0% |
| Wetting Agent | Akcros Chemicals | 0.45 | 100% |
| ASP 600 | RT Vanderbilt | 5.94 | 100% |
| Fumed Silica | Cabot Corporation | 1.20 | 100% |
| $Al_2O_3$, 9 micron | Treibacher Schleifmittel AG | 8.46 | 100% |

Examples 1–7

Belts in Examples 1 and 2, were prepared with high and low median crush strength levels of the abrasive particles on the belts respectively. Two strength levels were obtained by using two different glasses as the binder of the abrasive Agglomerates 1 and 2.

The final coating mixture for the diamond agglomerates was prepared using the Agglomerate reported in Table 7 with precursor in a ratio of 30:200. The mixture was doctor blade coated onto the pretreated woven backing described earlier. The coated backing was then transferred into an oven and heated from room temperature to 93° C. at a rate of 1.5° C./min. The temperature in the oven was held at 93° C. for 90 minutes. The oven is then heated to 110° C. at a rate of 0.7° C./min and is held at that temperature for a period of 9.25 hours.

Belts in Examples 3 and 4, were prepared with high and low median crush strength levels of the abrasive particles on the belts respectively. Two strength levels were obtained by using two different glasses as the binder of the abrasive Agglomerates 1 and 2 as in Example 1 and 2. The belts were first coated with the precursor with a doctor blade at gap of 0.125 mm and the particles were drop coated and packed with a rubber roll. After drying at room temperature more precursor was applied as a size coat with a paint roller. The coated backing was then transferred into an oven and heated from room temperature to 93° C. at a rate of 1.5° C./min. The temperature in the oven was held at 93° C. for 90 minutes. The oven is then heated to 110° C. at a rate of 0.7° C./min and is held at that temperature for a period of 9.25 hours.

The final coating mixture for Example 5 was prepared using Agglomerates 3 with a precursor ratio of 86:200 and was doctor blade coated onto the pretreated woven backing described earlier. The coated backing was then transferred into an oven and heated from room temperature to 93° C. at a rate of 1.5° C./min. The temperature in the oven was held at 93° C. for 90 minutes. The oven is then heated to 110° C. at a rate of 0.7° C./min and is held at that temperature for a period of 9.25 hours.

Examples 6 and 7 were prepared using Agglomerates 4 and 5 respectively, with an agglomerate to precursor ratio of 86:200. They were coated, dried, and cured under the same conditions as Examples 1 and 2.

TABLE 7

| | Agglomerate | Strength | Agglomerate Density (l/cm$^2$) | Agglomerate: Precursor Ratio | Abrasive |
|---|---|---|---|---|---|
| Example 1 | Agglomerate 1 | High | 74 | 30:200 | 50 micron diamond |
| Example 2 | Agglomerate 2 | Low | 74 | 30:200 | 50 micron diamond |
| Example 3 | Agglomerate 1 | High | 273 | — | 50 micron diamond |
| Example 4 | Agglomerate 2 | Low | 273 | — | 50 micron diamond |
| Example 5 | Agglomerate 3 | Low | 172 | 86:200 | 74 micron diamond |
| Example 6 | Agglomerate 4 | High | 172 | 86:200 | 40 micron CBN |
| Example 7 | Agglomerate 5 | High | 172 | 86:200 | 74 micron CBN |

Test Procedure

A Dynabrade 3 hp grinder equipped with a 145.5 mm (5.73 in) diameter drive wheel was used to run the 1.17 m (46 in) long belt. The wheel was run at 4000 rpm resulting in a surface speed of 30.5 m/s (6000 feet per minute). The grinder was run for 10 seconds without any load to assure coolant flow rate and belt speed had been established. Coolant, C320 obtained from Master Chemical Corporation of Perrysburg, Ohio, was diluted to 4% with water and supplied at the grinding interface with the help of a nozzle. The workpiece was plunged into the driven abrasive belt with the aid of Bimba 1712 pneumatic cylinder obtained from Bimba Manufacturing Company, Monee, Ill. Material removed as a function of time was recorded. At the beginning of the test and at the end of the test, the weights and or lengths of the work pieces were determined and recorded. The belt was supported using a 90 durometer polyurethane contact wheel at the point where the workpiece is plunged.

The workpieces that were used in these evaluations are presented in the following Table 8.

TABLE 8

Description of the ground workpieces

| Workpiece | Source | Size |
|---|---|---|
| D2 Steel | Northern State Steel (Bridgeview, IL) | 12.5 mm × 25 mm (0.5 in × 1 in) |
| GC712 Tungsten Carbide (WC) (88% WC/12% Co) | General Carbide Corporation (Greensburg, PA) | 12.5 mm × 25 mm (0.5 in × 1 in) |
| CRC-410 Coated D2 Steel | Praxair Surface Technologies (Indianapolis, IN) | 12.5 mm × 25 mm (0.5 in × 1 in) |
| 1350 Coated D2 Steel | Praxair Surface Technologies (Indianapolis, IN) | 12.5 mm × 25 mm (0.5 in × 1 in) |

Conventional single-layer diamond or CBN belts generally exhibit a decline in material removing ability during use as shown in Table 9. Although the initial cut rate of the mono-layer belt, Comparative Example A, (6450J flex diamond 50 obtained from 3M Corporation of Maplewood, Minn.) started at about 0.2 mm/min (0.008 in/min), after one hour of grinding the cut rate had declined to 0.0813 mm/min (0.0032 in/min) and after six ours of grinding the cut rate further declined to 0.0076 mm/min (0.0003 in/min.)

The cut rate associated with the Example 3 belt dropped to 0.0965 mm/min (0.0038 in/min) within the first hour. After an additional six hours the cut rate was still about 0.0864 mm/min (0.0034 in/min.)

All belts started out at high tungsten carbide removal rates. Rates declined significantly during the first hour. This is a behavior common to many coated abrasive belts. The majority of a grinding operation is performed after the initial sharp decline. Table 9 indicates the removal rates of tungsten carbide by the abrasive belts as a function of time. A conventional monolayer diamond belt, Comparative Example A, is also shown in Table 9.

TABLE 9

WC removal rate by each belt in mm/min as a function of time

| Time [hours] | Comparative Example A | Example 1 | Example 2 | Example 3 | Example 4 |
|---|---|---|---|---|---|
| 1 | 0.0813 | 0.0889 | 0.0864 | 0.0965 | 0.0991 |
| 2 | 0.0635 | 0.0889 | 0.0838 | 0.0991 | 0.1016 |
| 3 | 0.0533 | 0.0762 | 0.0838 | 0.0991 | 0.1016 |
| 4 | 0.0432 | 0.0711 | 0.0787 | 0.1041 | 0.0965 |
| 5 | 0.0305 | 0.0559 | 0.0711 | 0.0991 | 0.0889 |
| 6 | 0.0076 | 0.0432 | 0.0559 | 0.0864 | 0.0762 |

Tests comparing CBN agglomerate belts, Examples 6 and 7, and Comparative Example B (designated 6450J flex diamond 74 obtained from 3M Corporation of Maplewood, MN) as well as a conventional monolayer plated flexible CBN belt, Comparative Example C, designated 1451J Flex CBN 125 (obtained from 3M Corporation of Maplewood, Minn.) are summarized in Table 10. The CRC-410 coatings were obtained from Praxair Inc. of Danbury, Conn. The tested samples were supplied on a D2 steel workpiece. Praxair Surface Technologies, Inc., located in Indianapolis, Ind., applied these coatings. All grinding tests were terminated before the coating exposed the underlying workpiece.

TABLE 10

Grinding Rate (in g/min) results for Praxair CRC-410 coating on D2 Steel.

| | Bar 1/ Coating Removal Rate (g/min) | Bar 2/ Coating Removal Rate (g/min) | Bar 3/ Coating Removal Rate (g/min) | Bar 4/ Coating Removal Rate (g/min) |
|---|---|---|---|---|
| Comparative Example B | 0.0018 | 0.0018 | — | — |
| Example 6 | 0.0013 | 0.0013 | — | — |
| Comparative Example C | 0.0233 | 0.0220 | 0.0217 | 0.019 |
| Example 7 | 0.1060 | 0.1080 | 0.097 | 0.09 |

Tests comparing CBN agglomerate belts, a diamond agglomerate belt and a conventional monolayer plated flexible diamond belt, Comparative Example B, 6450J Flex Diamond 74 obtained from 3M Corporation of Maplewood, Minn. are presented in Table 11. CRC-1350 coatings are commercially available from Praxair Inc. of Danbury, Conn. The tested samples were supplied on a D2 Steel workpiece. Praxair Surface Technologies, Inc. located in Indianapolis, Ind. applied these coatings. All grinding tests were terminated before the coating exposed the underlying workpiece.

TABLE 11

Grinding Rate results for Praxair 1350 coating on D2 Steel.

| | Bar 1/ Coating Removal Rate (g/min) | Bar 2/ Coating Removal Rate (g/min) | Bar 3/ Coating Removal Rate (g/min) | Bar 4/ Coating Removal Rate (g/min) |
|---|---|---|---|---|
| Comparative Example B | 0.0195 | 0.0168 | 0.0158 | 0.0148 |
| Example 5 | 0.0218 | 0.0475 | 0.0517 | 0.0475 |
| Example 7 | 0.0250 | 0.0130 | 0.0130 | 0.0090 |

Various modifications and alterations of the present invention will become apparent to those skilled in the art without departing from the spirit and scope of the invention.

What is claimed is:

1. A method of polishing a workpiece comprising providing an abrasive article, the abrasive article comprising superabrasive particles within agglomerates;

contacting the abrasive article with a workpiece outer surface, the workpiece outer surface comprising a thermal spray hard phase and a bonding phase; and relatively moving the abrasive article and the workpiece.

2. The method of claim 1 wherein the thermal spray hard phase comprises a metal oxide.

3. The method of claim 2 wherein the metal oxide comprises aluminum oxide.

4. The method of claim 2 wherein the metal oxide comprises zirconium oxide.

5. The method of claim 1 wherein the thermal spray hard phase comprises a carbide.

6. The method of claim 5 wherein the carbide comprises titanium carbide.

7. The method of claim 5 wherein the carbide comprises chromium carbide.

8. The method of claim 5 wherein the carbide comprises tungsten carbide.

9. The method of claim 1 wherein the thermal spray coating comprises a nitride.

10. The method of claim 9 wherein the nitride comprises titanium nitride.

11. The method of claim 9 wherein the nitride comprises silicon nitride.

12. The method of claim 1 wherein the thermal spray hard phase comprises a metal.

13. The method of claim 12 wherein the metal comprises a chrome-nickel-boron alloy.

14. The method of claim 1 wherein the bonding phase comprises a metallic material.

15. The method of claim 14 wherein the metallic material comprises nickel, chromium, cobalt, or combinations thereof.

16. The method of claim 1 wherein the bonding phase comprises a metallic oxide material.

17. The method of claim 1 wherein the thermal spray hard phase is tungsten carbide and the bonding phase is cobalt.

18. The method of claim 1 wherein the agglomerates comprise abrasive particles within a glass binder.

19. The method of claim 1 wherein the abrasive article is a continuous belt.

20. The method of claim 1 wherein the abrasive article is a resin bonded disk.

21. The method of claim 1 wherein the agglomerates are irregularly shaped.

22. The method of claim 1 wherein the agglomerates have a precise shape.

23. The method of claim 22 wherein the agglomerates are a cube, pyramid, truncated pyramid, or a sphere.

* * * * *

UNITED STATES PATENT AND TRADEMARK OFFICE

CERTIFICATE OF CORRECTION

PATENT NO. : 6,951,504 B2
DATED : October 4, 2005
INVENTOR(S) : Adefris, Negus B.

It is certified that error appears in the above-identified patent and that said Letters Patent is hereby corrected as shown below:

Column 3,
Line 26, delete ""icapping"" and insert -- "capping" --.

Column 14,
Lines 1, 7, 9 and 11, after "wherein the" insert -- abrasive --.

Signed and Sealed this

Fourth Day of April, 2006

JON W. DUDAS
*Director of the United States Patent and Trademark Office*